US010722934B2

(12) United States Patent
Levey

(10) Patent No.: US 10,722,934 B2
(45) Date of Patent: Jul. 28, 2020

(54) THREAD ROLLING ASSEMBLY

(71) Applicant: Kenneth Roger Levey, Chicago, IL (US)

(72) Inventor: Kenneth Roger Levey, Chicago, IL (US)

(73) Assignee: Vey Manufacturing Technologies LLC, Chicago, IL (US)

( * ) Notice: Subject to any disclaimer, the term of this patent is extended or adjusted under 35 U.S.C. 154(b) by 314 days.

(21) Appl. No.: 15/685,845

(22) Filed: Aug. 24, 2017

(65) Prior Publication Data

US 2018/0056367 A1 Mar. 1, 2018

Related U.S. Application Data

(60) Provisional application No. 62/379,818, filed on Aug. 26, 2016.

(51) Int. Cl.
*B21H 3/02* (2006.01)

(52) U.S. Cl.
CPC ..... *B21H 3/022* (2013.01); *B21H 3/02* (2013.01)

(58) Field of Classification Search
CPC ..... B21H 3/06; B21H 3/022; B21H 3/025; B21H 3/027; B21H 3/02; B21H 3/00; B21H 3/04
See application file for complete search history.

(56) References Cited

U.S. PATENT DOCUMENTS 470,805 A 3/1892 Jones
503,393 A * 8/1893 Vollmer ..... B21H 3/06 72/90
2,367,398 A 1/1945 Hoern
2,548,137 A 4/1951 Appleton
2,603,879 A 7/1952 Jaochim
3,726,118 A 4/1973 van de Meerendonk
3,765,209 A * 10/1973 Petrikovsky ..... B21H 3/06 72/90
3,879,976 A * 4/1975 Morton ..... B21H 9/02 72/90
3,926,026 A 12/1975 Jackson
4,229,966 A 10/1980 Jackson
4,583,385 A 4/1986 Jackson
4,754,631 A 5/1988 Jackson
8,984,922 B2 3/2015 Roth
(Continued)

FOREIGN PATENT DOCUMENTS

DE 3008113 A1 * 9/1981 ..... B21H 3/06
DE 3535282 4/1986
(Continued)

OTHER PUBLICATIONS

Machine Translation of DE-3008113-A1 from ESPACENET, Leopold, Publication Year 1981, Total pp. 11 (Year: 2019).*
(Continued)

*Primary Examiner* — Teresa M Ekiert
*Assistant Examiner* — Sarkis A Aktavoukian
(74) *Attorney, Agent, or Firm* — Christopher M. Scherer; DeWitt LLP

(57) ABSTRACT

Cold-forming equipment configured as a high precision thread rolling assembly utilizing racks, guide rails, a bearing assembly including rolling element linear motion bearings and a gear reduction assembly.

6 Claims, 13 Drawing Sheets

(56) References Cited

U.S. PATENT DOCUMENTS

Figure 1:
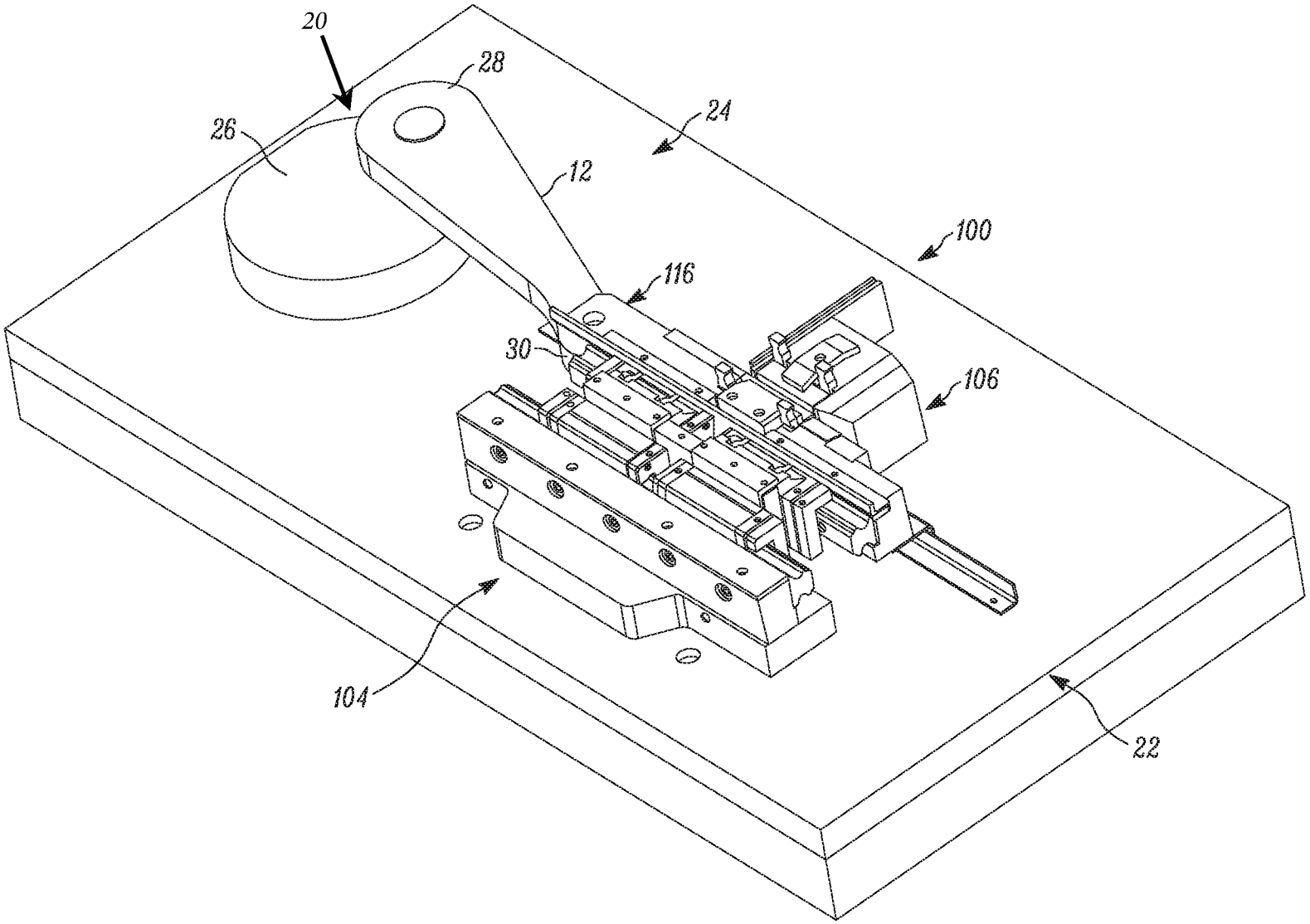

| | | | |
|---|---|---|---|
| 2001/0039820 | A1 | 11/2001 | Shinbutsu et al. |
| 2002/0013178 | A1 | 1/2002 | Kato et al. |
| 2010/0126073 | A1 | 5/2010 | Schroeder et al. |
| 2016/0030998 | A1 | 2/2016 | Levey et al. |
| 2018/0056367 | A1 | 3/2018 | Levey |

FOREIGN PATENT DOCUMENTS

| | | | | | |
|---|---|---|---|---|---|
| DE | 10259665 | | | 7/2004 | |
| EP | 0119797 | A1 | | 9/1984 | |
| EP | 1072337 | | | 1/2001 | |
| EP | 2380678 | | | 10/2011 | |
| GB | 2044151 | | | 10/1980 | |
| JP | 56045242 | A | * | 4/1981 | ..... B21H 3/06 |
| JP | 2003033842 | | | 2/2003 | |
| WO | 8001886 | | | 9/1980 | |

OTHER PUBLICATIONS

Machine Translation of JP-56045242-A from J-Plat Pat, Fukuma, Publication Year 1981, Total pp. 5 (Year: 2019).*
International Search Report dated Oct. 26, 2017 issued in connection with PCT/US2017/048717; 3 pages.
International Written Opinion dated Oct. 26, 2017 issued in connection with PCT/US2017/048717; 8 pages.
International Search Report and Written Opinion for PCT/US2019/042236 dated Oct. 24, 2019.
Office Action for U.S. Appl. No. 16/514,641 dated Oct. 24, 2019.
Search Report for EP17844526.8 dated Mar. 25, 2020.

* cited by examiner

THREAD ROLLING ASSEMBLY

CROSS-REFERENCE TO RELATED APPLICATIONS

This application is a Non-Provisional Patent Application that claims the benefit of and priority to the U.S. Provisional Patent Application No. 62/379,818 filed on Aug. 26, 2016, which is incorporated by reference herein in its entirety.

BACKGROUND OF THE DISCLOSURE

The present disclosure generally relates to roll forming, pattern rolling machines. More particularly, the present disclosure relates to a high precision thread rolling machine assembly having a gear reduction assembly disposed between a pair of bearing assemblies.

Cold forming of a thread, gear tooth or other pattern upon a cylindrical blank utilizing reciprocating, symmetrical dies represents known technology. Examples are found in U.S. Pat. Nos. 387,184; 3,793,866 and 4,712,410. Such machines have not significantly changed since their initial design starting in the late 1800's. All machines manufactured to date use oil film ways, a moving carrier die block and threaded adjustments to compensate for all variations in the blank material to be formed, the tooling that used for forming and the natural tolerance variation and drift in traditional oil film ways. All modern, high precision manufacturing equipment such as CNC machining equipment current use linear bearings. The use of linear bearings in roll forming for threaded fasteners and other shapes has not been adapted because the required manufacturing speed (approximately 300 parts per minute) is beyond the current performance of any known linear bearing manufacturer.

Machine screws with rolled threads are widely used in industry. They are typically formed using known flat die technology in existence for many years. The commonly used flat rolling dies include a stationary (short) die on a stationary platen and a reciprocating (long) die on a reciprocating slide arranged in face-to-face relation.

As known by one of skill in the art, the machine drive advances the moving reciprocating or moving carrier die block to create the thread form. Though reliable, these machines require experienced operators to setup and run. The thread rolling machines most commonly used today represent technology developed long ago, with heavy metal components subject to wear and often requiring expensive adjustments and repairs.

In particular, all conventional thread rolling machines use a linear motion guideway commonly referred to as a hydrostatic linear motion bearing, commonly referred to as an oil film way. The oil film of the hydrostatic bearing stands up to the high pressure, oscillating manufacturing method of thread rolling, but the moving carrier die block attached thereto is subject to movement variation due the hydrostatic bearing and wear.

In all other high precision manufacturing equipment where an oil film way was used in the past has been replaced with a rolling element linear motion bearing that decreases friction by using rolling contact via rolling elements (balls, roller, etc.) that are placed between two relatively moving objects to provide highly accurate positioning operation.

However, simple direct replacement of an oil film way on a conventional thread rolling machine with a rolling element linear motion bearing assembly will fail without addressing two substantial and significant obstacles. First, manufacturing speeds for conventional thread rolling machines require approximately 300 strokes per minute and rolling element linear motion bearings cannot safely or efficiently operate at this speed. Second, the machine drive of conventional thread rolling machines operates on a well-understood slider-crank principal to translate rotary movement to linear movement. The machine drive commonly includes a pitman arm having a proximal end connected to the moving reciprocating die and a distal end connected to a flywheel. Rotation of the flywheel moves the proximal end of the pitman arm and the moving reciprocating die connected thereto in a linear reciprocating movement. Consequently, unwanted off-angle and reaction forces act upon the moving, reciprocating die during roll forming operations. Unfortunately, rolling element linear motion bearings operate at their highest life capability when the rolling or oscillation force is directly in-line with the guide rail.

Therefore, there is a long felt but unresolved need in the art for a high precision thread rolling machine with a rolling element linear motion bearing assembly for the advantages that have been previously recognized and that overcome the disadvantages of the prior art and the obstacles to implementation.

BRIEF DESCRIPTION OF THE SEVERAL VIEWS OF THE DRAWING(S)

The foregoing background, as well as the following detailed description of the disclosure, is better understood when read in conjunction with the appended drawings. For the purpose of illustrating the disclosure, exemplary constructions of the inventions of the disclosure are shown in the drawings. However, the disclosure and the inventions herein are not limited to the specific methods and instrumentalities disclosed herein.

FIG. 1 exemplarily illustrates a perspective view of a high precision thread rolling assembly of the present disclosure (with safety guards not shown) disposed on a conventional thread rolling machine.

Figure 2:
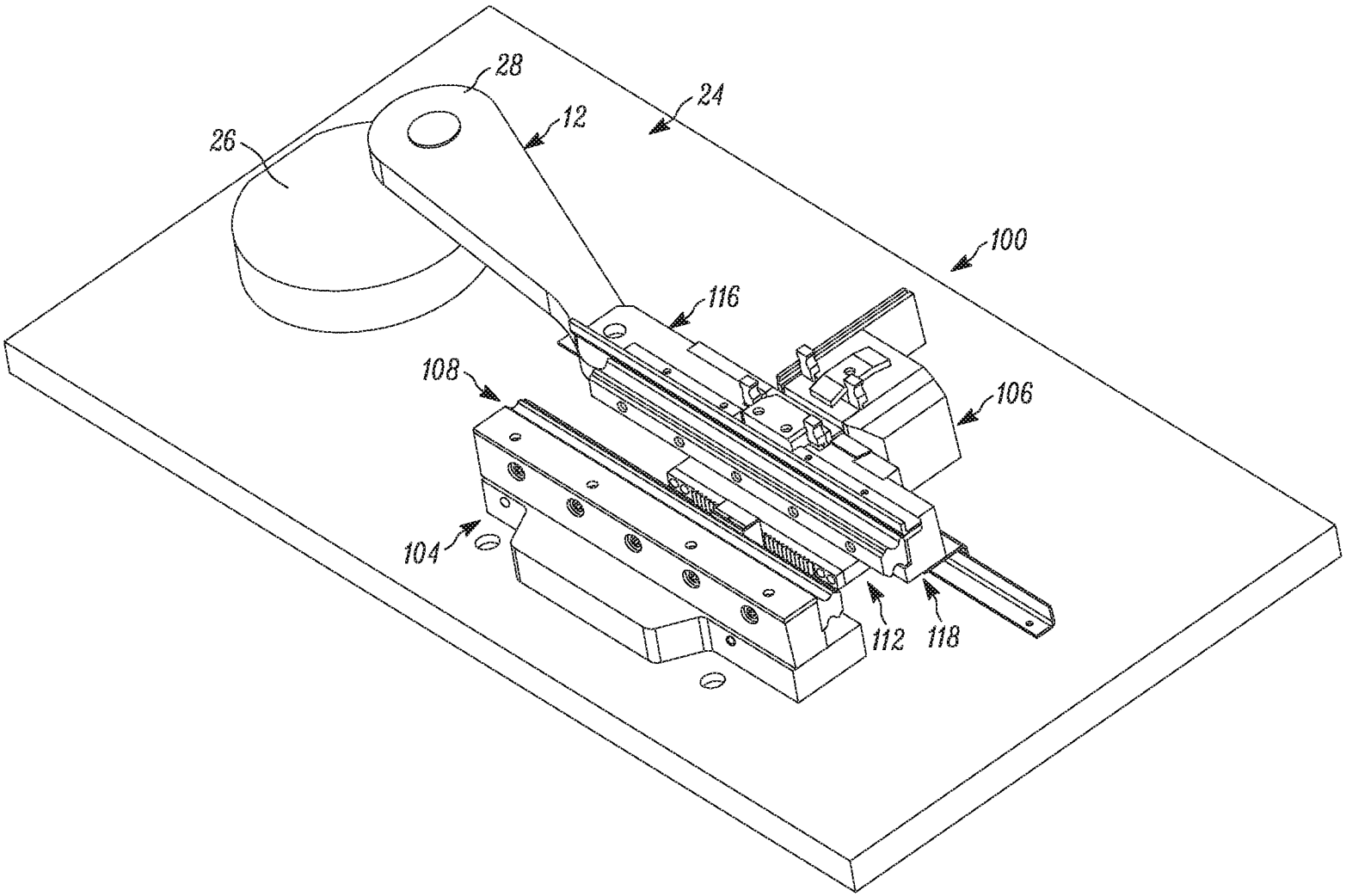

FIG. 2. exemplarily illustrates a perspective view of the high precision thread rolling assembly of FIG. 1 with a bearing assembly removed.

Figure 3:
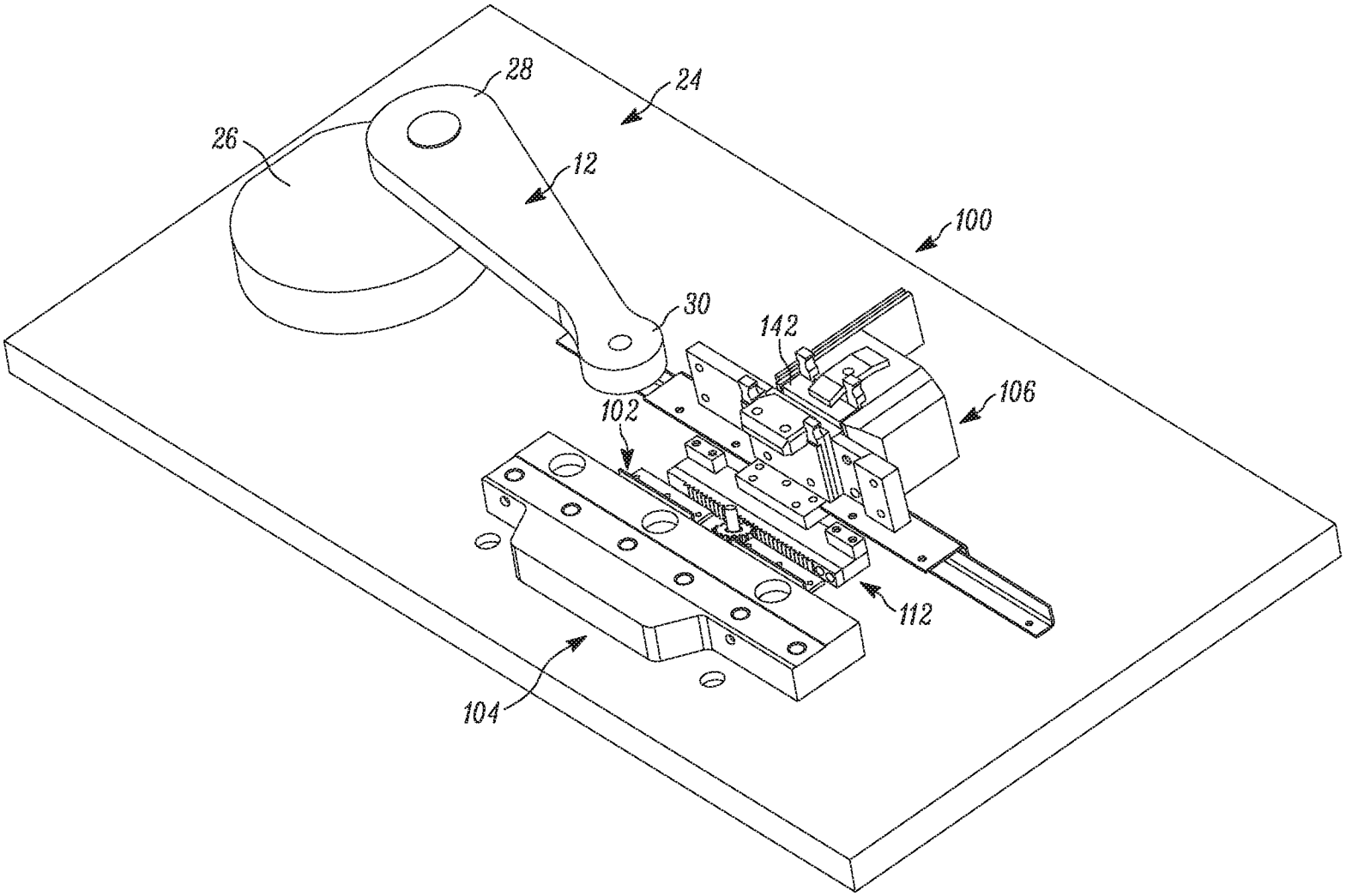

FIG. 3 exemplarily illustrates a perspective view of the high precision thread rolling assembly of FIG. 2 with guide rails and moving die removed.

Figure 4A:
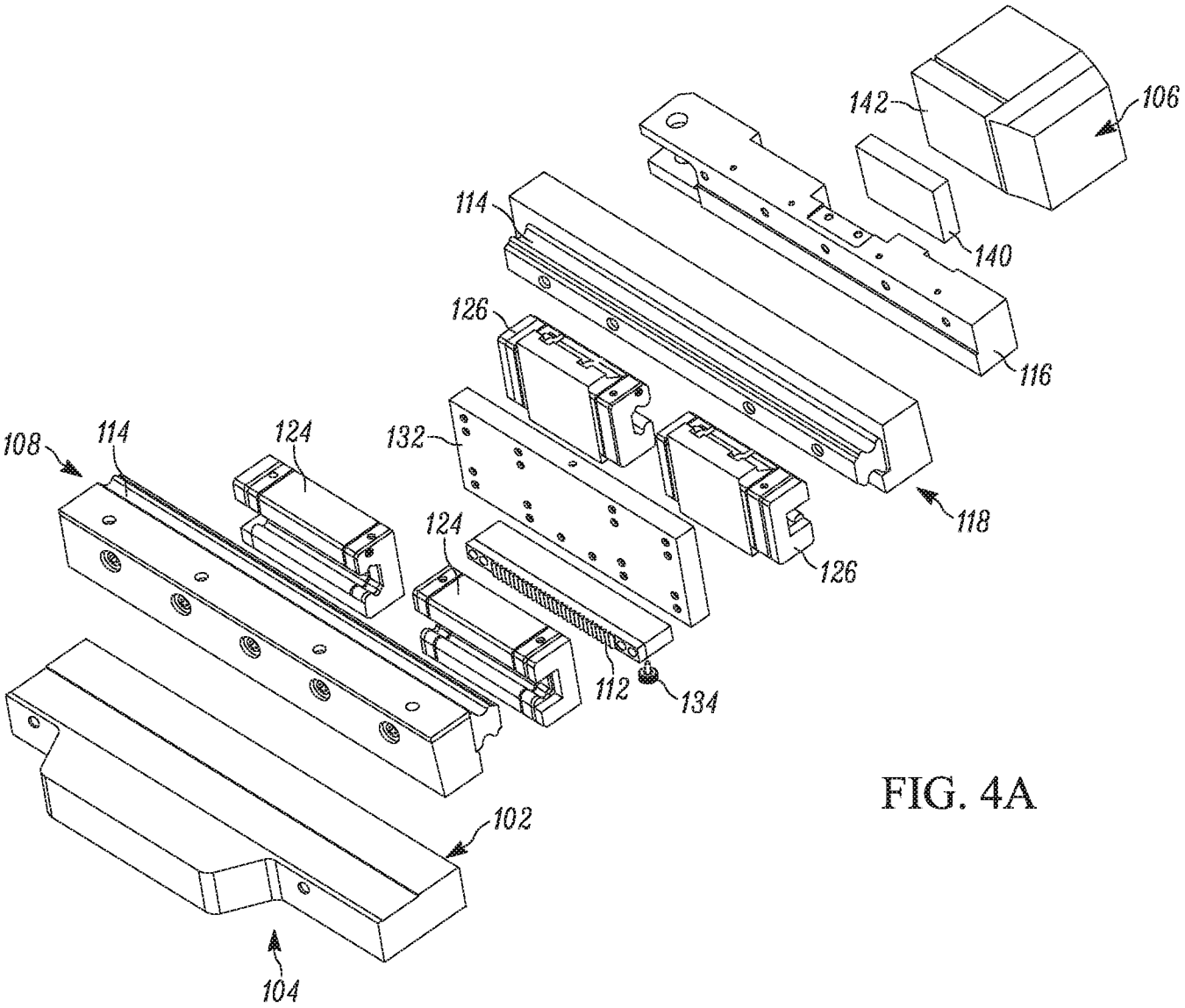

FIG. 4A exemplarily illustrates an exploded view of the high precision thread rolling assembly of FIG. 1.

Figure 4B:
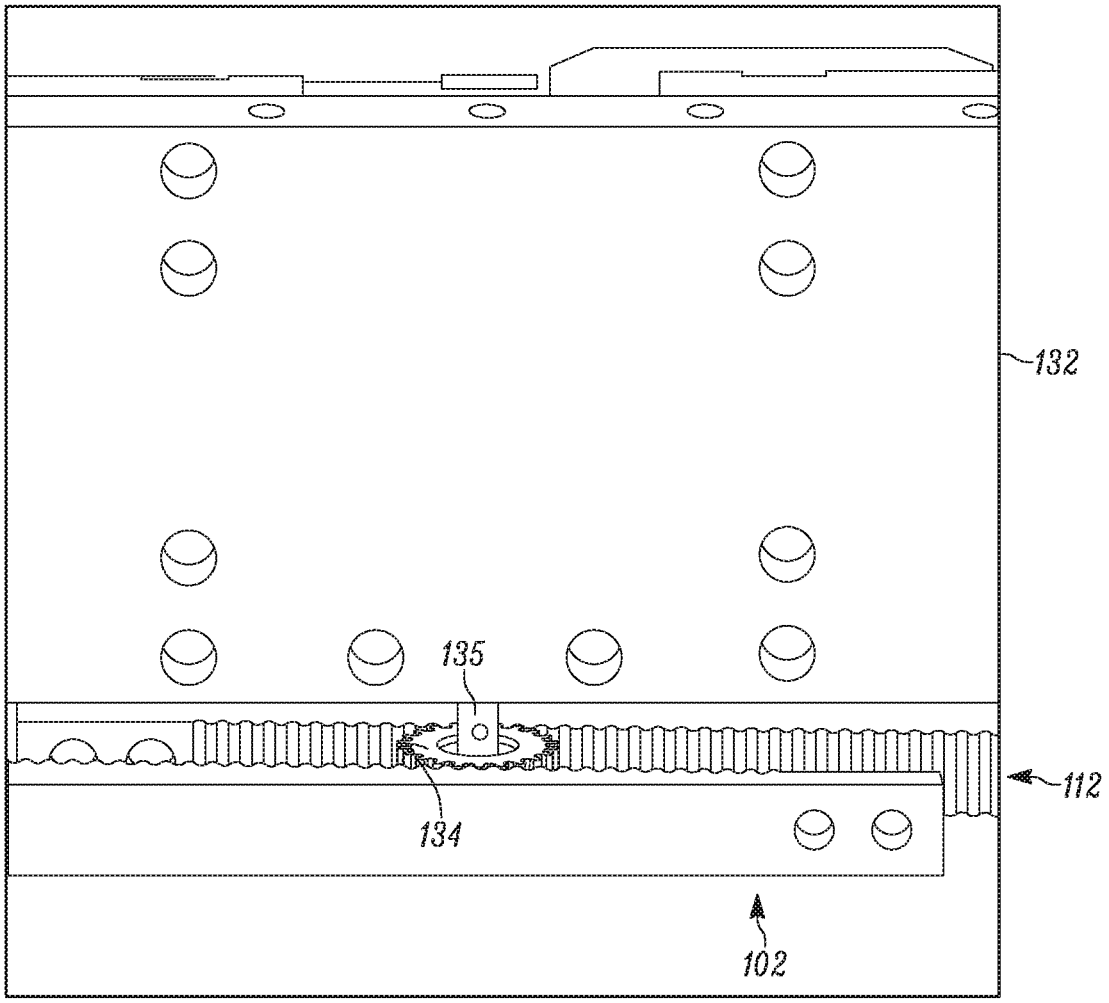

FIG. 4B exemplarily illustrates a partial broken away detail view of certain components of a gear reduction assembly of the high precision thread rolling assembly of FIG. 1.

Figure 5A:
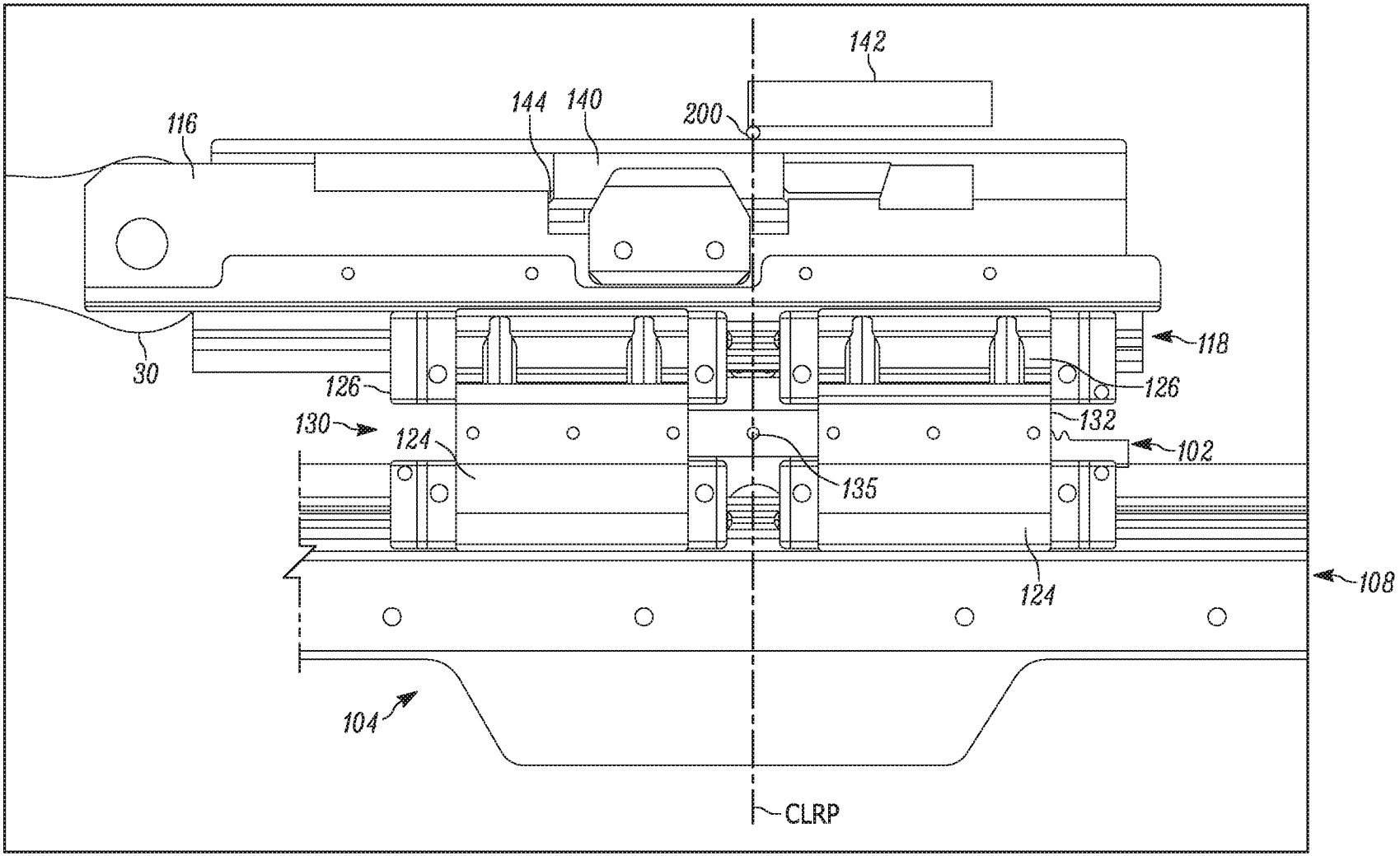

FIG. 5A exemplarily illustrates a top partial broken away detail view of certain components of the high precision thread rolling assembly of FIG. 1 at the beginning of a thread forming stroke.

Figure 5B:
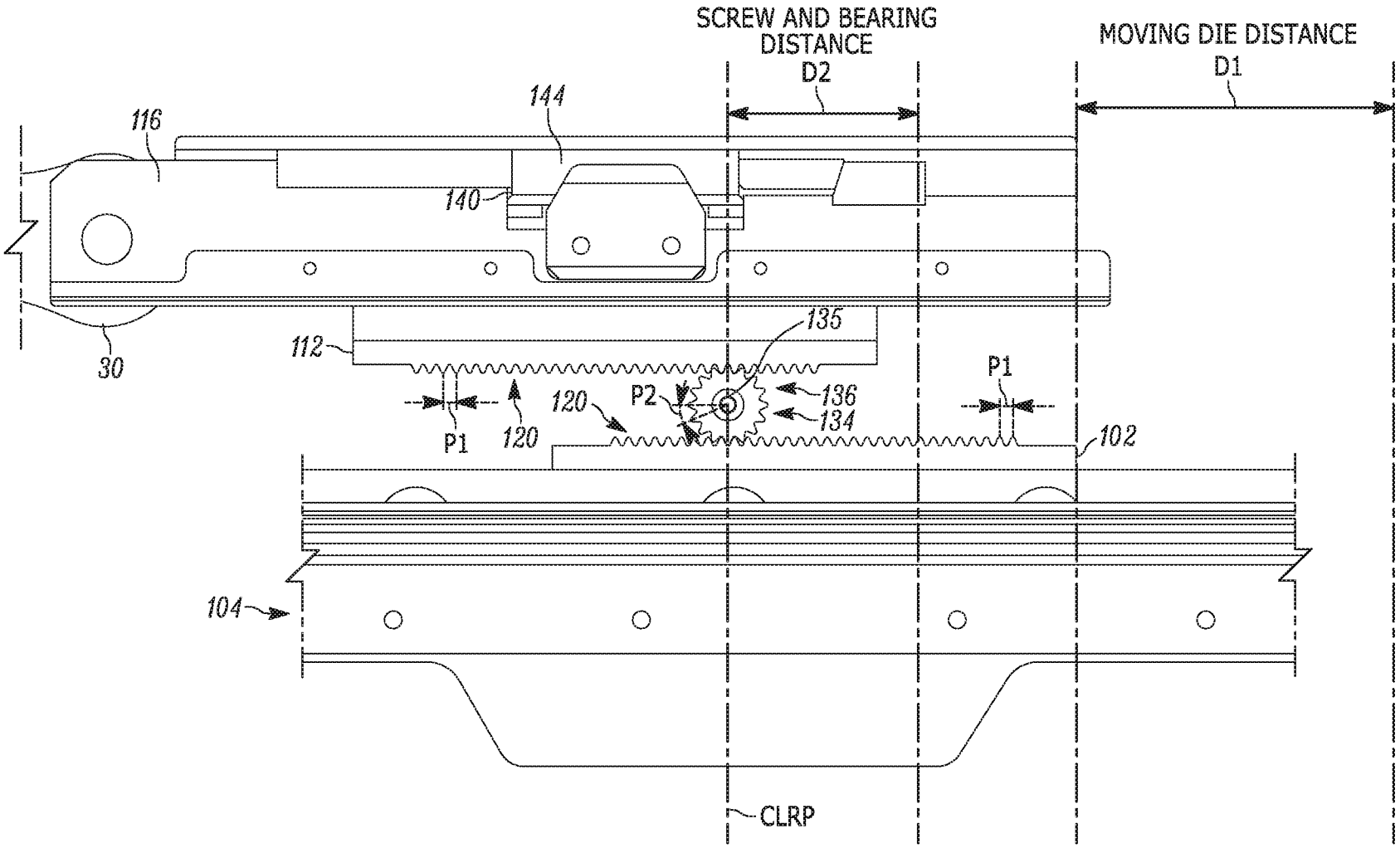

FIG. 5B exemplarily illustrates a top partial broken away detail view of certain components of the high precision thread rolling assembly of FIG. 5A with bearing assembly and stationary die removed.

Figure 6:
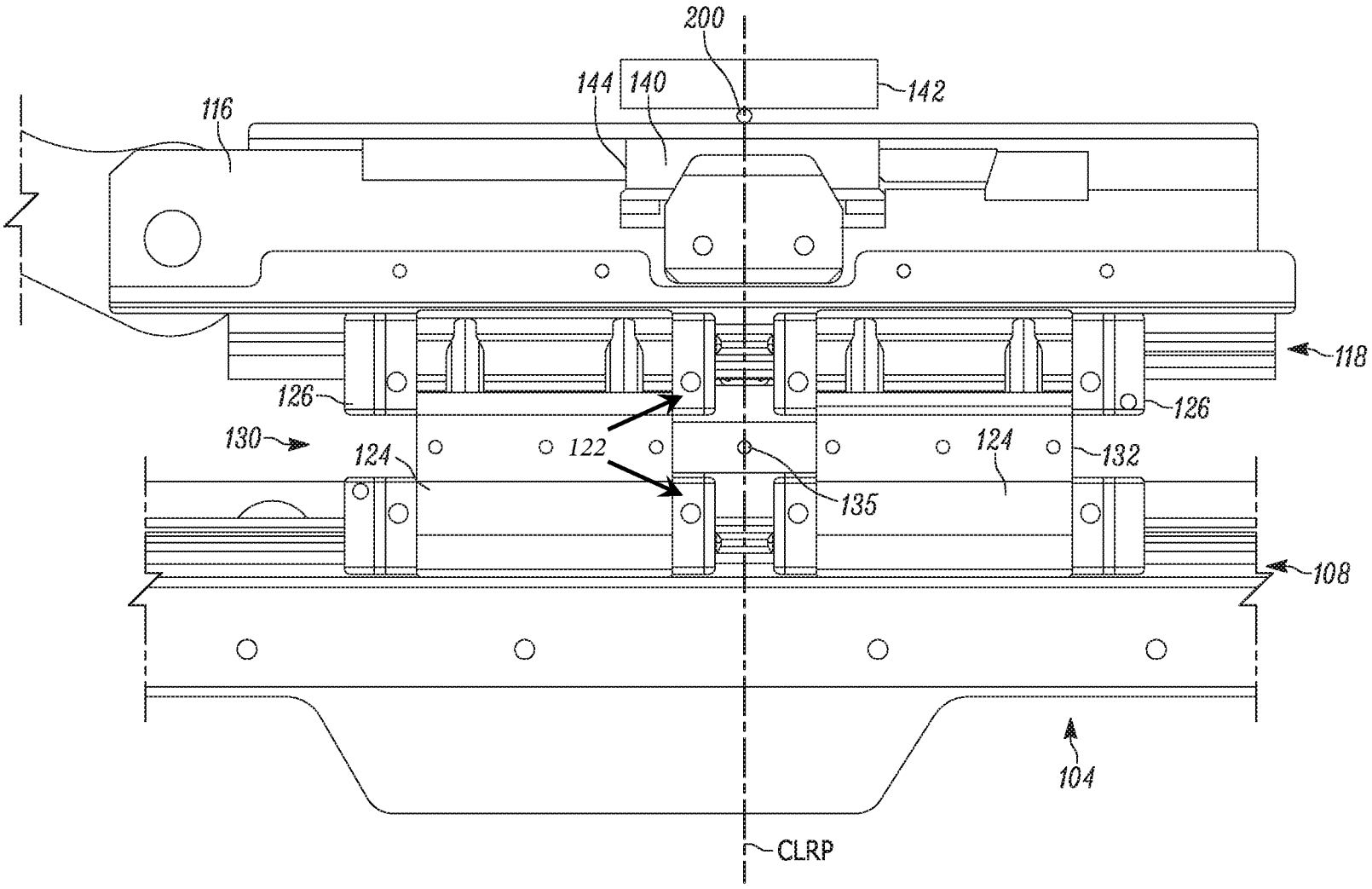

FIG. 6 exemplarily illustrates a top partial broken away detail view of certain components of the high precision thread rolling assembly of FIG. 1 at the center of the thread forming stroke.

Figure 7A:
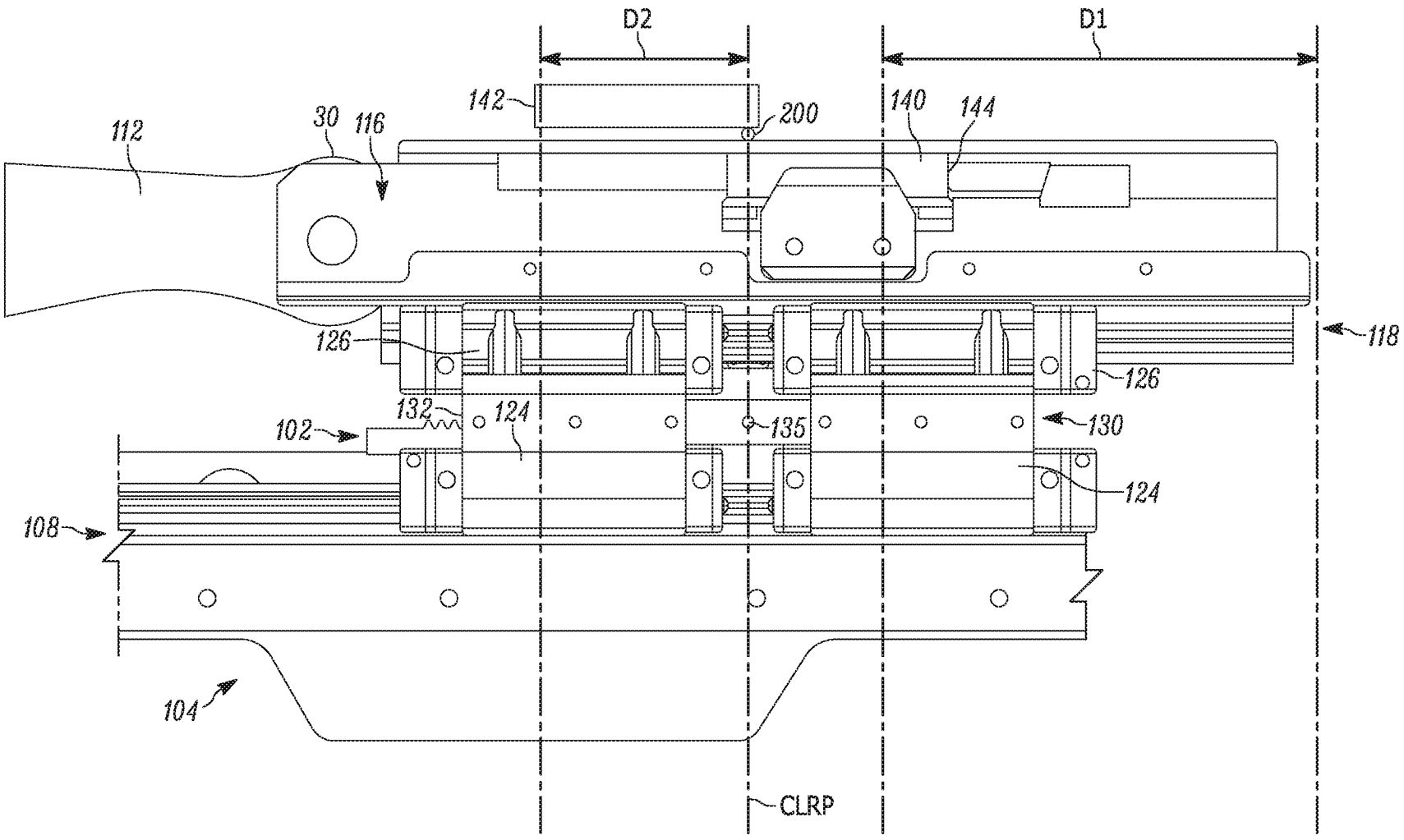

FIG. 7A exemplarily illustrates a top partial broken away detail view of certain components of the high precision thread rolling assembly of FIG. 1 at the end of the thread forming stroke.

Figure 7B:
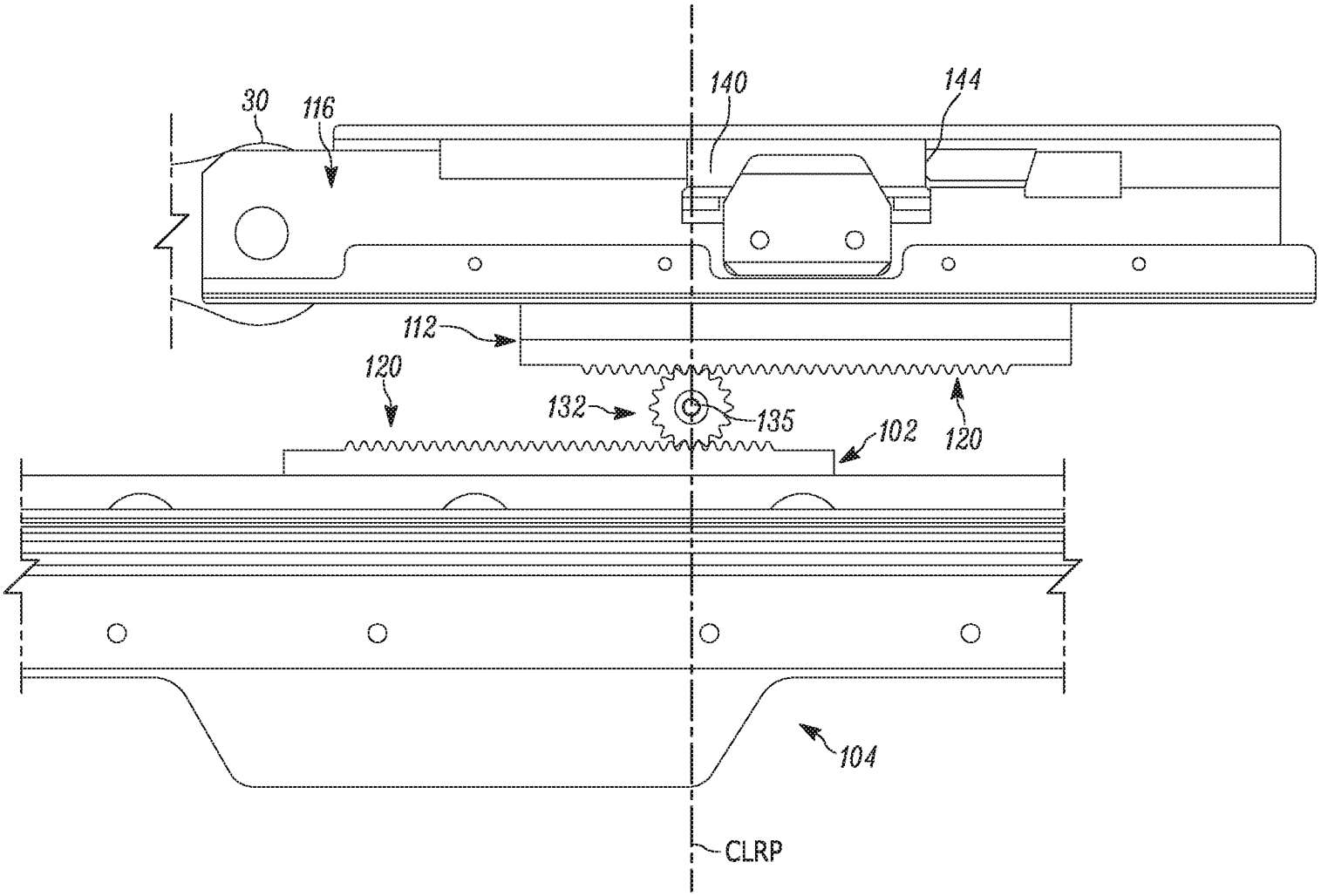

FIG. 7B exemplarily illustrates a top partial broken away detail view of certain components of the high precision thread rolling assembly of FIG. 7A with bearing assembly and stationary die removed.

Figure 8:
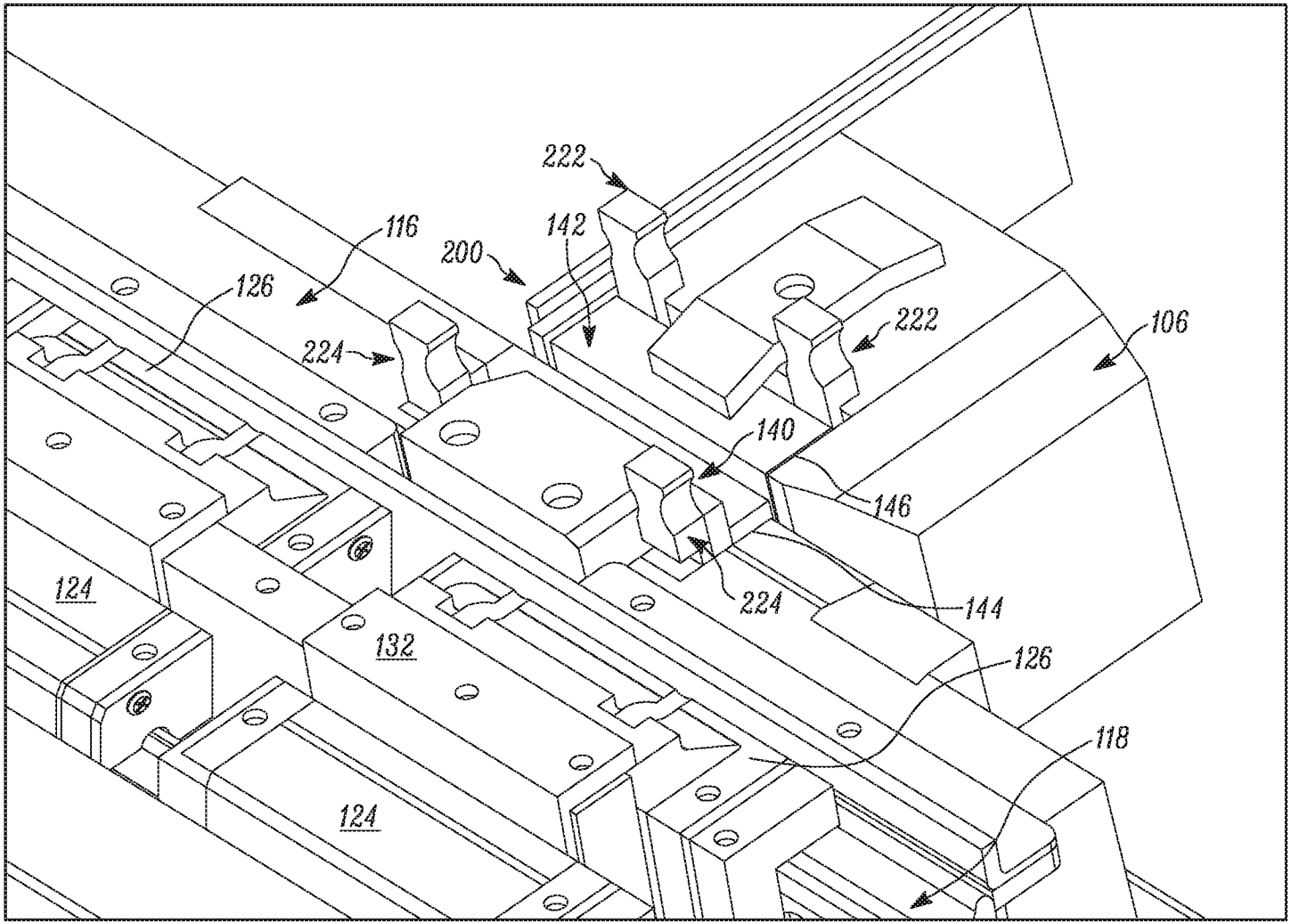

FIG. 8 exemplarily illustrates a perspective partial broken away detail view of certain components of the high precision thread rolling assembly of FIG. 1 for a die adjusting assembly.

Figure 9:
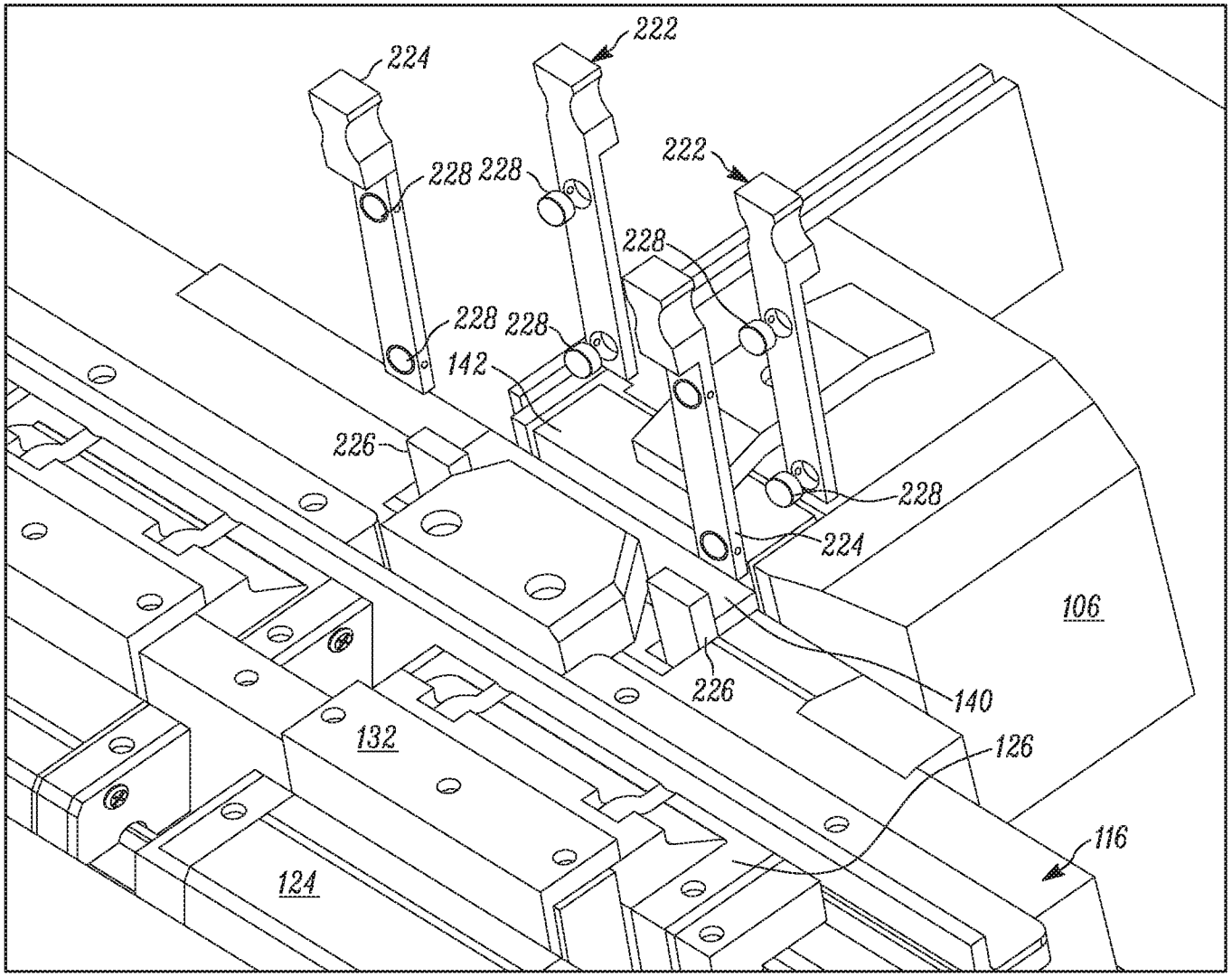

FIG. 9 exemplarily illustrates a partially exploded view of the die adjusting assembly of FIG. 8.

Figure 10:
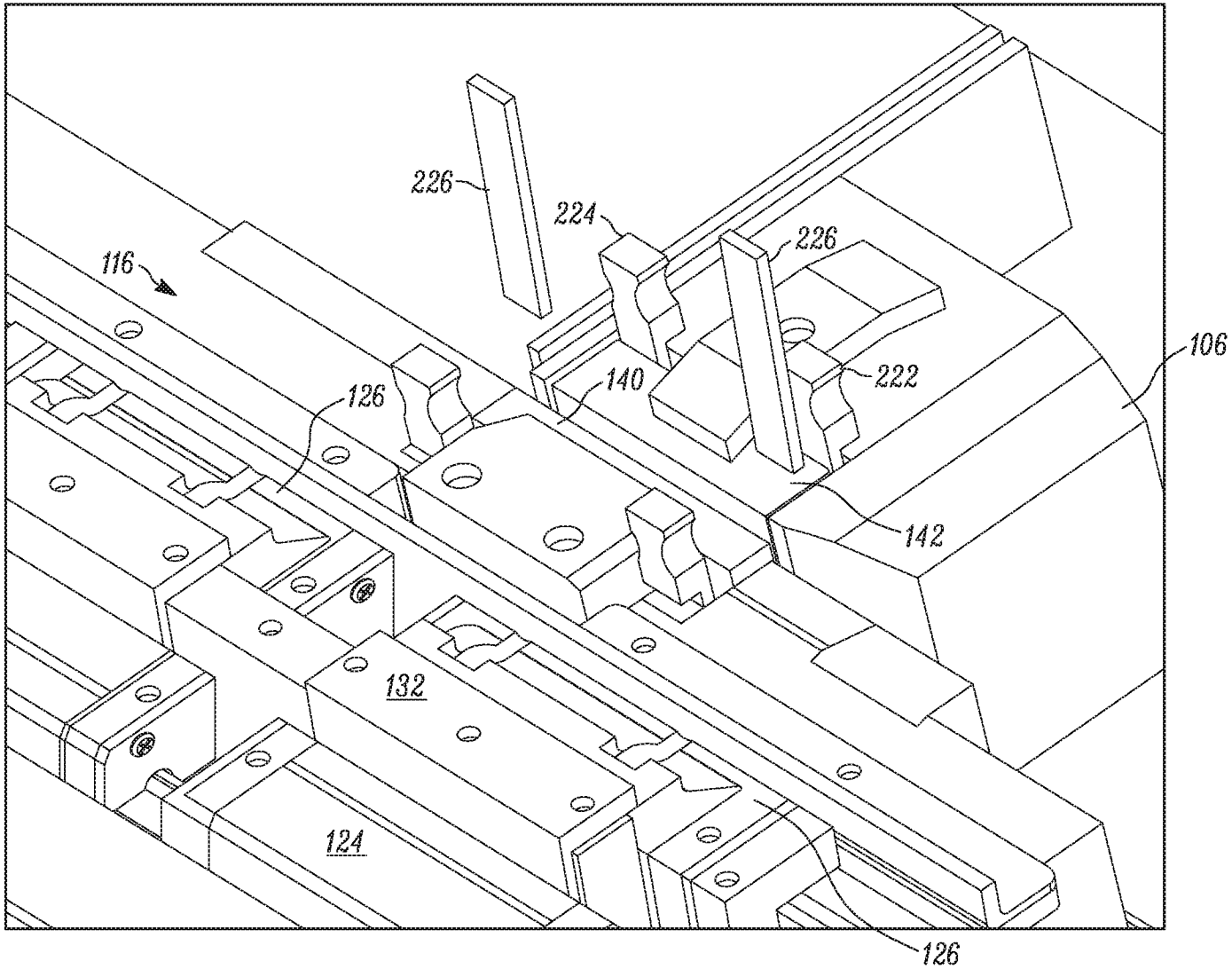

FIG. 10 exemplarily illustrates a partially exploded view of the die adjusting assembly of FIG. 8.

DETAILED DESCRIPTION OF THE DISCLOSURE

The following disclosure as a whole may be best understood by reference to the provided detailed description when read in conjunction with the accompanying drawings, drawing description, abstract, background, field of the disclosure, and associated headings. Identical reference numerals when found on different figures identify the same elements or a functionally equivalent element. The elements listed in the abstract are not referenced but nevertheless refer by association to the elements of the detailed description and associated disclosure.

The present disclosure is directed to cold forming equipment directed to a thread rolling machine of advanced design utilizing aspects of currently available technology, such as light weight linear guideways in the form of rolling element linear motion bearings operating on re-circulating bearings and a gear reduction assembly that eliminates off-angle and reaction forces. Implementation of the disclosed equipment should revolutionize cold forming of threaded fasteners and other similarly manufactured cylindrical, patterned products.

One of skill in the art will recognize that replacing the existing inaccurate oil film way that guided the moving die of a conventional thread rolling machine with a high precision bearing assembly will dramatically improve rolled part quality and stability (i.e., an initial set up should make 1,000,000+ parts consistently with little to no variation, without adjustment, rather than current equipment which requires lots of adjustments due to temperature and oil viscosity changes) and decrease overall machine set up time.

In one embodiment, the high precision thread rolling assembly 100 can be configured as an upgrade, retro-fit rebuild kit for conventional equipment wherein existing equipment, such as a base, part feeding rails, pitman arm, and stationary die block are not changed.

The high precision thread rolling assembly 100 is advantageous in that it installs to existing equipment using the existing bolt pattern as a direct replacement and is adjusted in some respects the same way as is currently performed (other than a novel adjustment assembly as disclosed herein).

In another embodiment, the high precision thread rolling assembly 100 can be configured as a new, stand-alone assembly with any suitable reciprocating drive assembly, a stationary die and part feeding rails.

Yet another advantage of the high precision thread rolling assembly 100 is that it further provides an engineered setup solution for the tooling, thereby eliminating the manual adjustment of every setup. In a conventional thread rolling machine, every time a thread rolling tool is installed, the operator is required to use their expertise and judgment to set up the machine. Every setup is unique, without a known location of the die pocket and the natural variability of the oil film way, constant adjustment is required during operation. For example, there is a minimum of two adjustments used every time a new thread roll die is installed. These adjustments are made with a threaded adjuster that adds or subtracts (pressure/distance) between the moving die and the stationary die. All equipment physically moves on the oil film ways.

The high precision thread rolling assembly is advantageous in that the die pocket dimension is known and a set-up adjustment recipe can be created in advance and utilized by unskilled workers. For example, a method for set-up adjustment for the high precision thread rolling assembly 100 may include measuring the top and bottom of the cylindrical blank diameter; and measuring the die face thickness. The distance between the die faces at the beginning of the rolling process is a specific value and the distance between the die faces at the end of the rolling process is exactly the root diameter of the screw. It should be noted the volume of the finished part is the exact same as the cylindrical blank diameter before rolling. However, in some cases there is a known amount of stretch and/or a known amount of material is pinched of making a screw with a sharp tip.

Like a conventional thread rolling machine, high precision thread rolling assembly 100 of the present disclosure includes a base 22 having a work platform 24 upon which a flywheel 26 is mounted for rotational movement with respect thereto. A pitman arm 12 is movably connected at a distal end 28 to the flywheel 26. Preferably, the pitman arm 12 is rotationally, pivotally, etc. or the like movable with respect to the flywheel 26. The pitman arm 12 also movably connected at a proximal end 30 to a moving die block 116.

Preferably, the high precision thread rolling assembly 100 shown in FIGS. 1-10 replaces the oil film ways and adjusting mechanism of the conventional thread rolling machine and may be disposed on the work platform 24 that includes a mounting flange 104. One of skill in the art will recognize that the mounting flange 104 may have any suitable shape in order to perform the intended functionality. For example, mounting flange 104 may be formed as a block, a plate, a cylinder, a tube, an "L", or the like, etc. so as to enable or facilitate connection or coupling between the work platform 24 and the high precision thread rolling assembly 100.

In one embodiment, as shown in FIGS. 1-4B, the high precision thread rolling assembly 100 may include a first rack 102 and a first guide rail 108 each engaging one of the mounting flange 104 and the work platform 24. It will be understood by one of skill in the art that the expression "engaging" in this particular instance will be read as broadly as possible so as to encompass the first rack 102 and first guide rail 108 connected to one of the mounting flange 104 and work platform 24 by any form or manner of connection as commonly known and understood in the art for the applicable structure. For example, threaded fasteners, push-to-lock, over-center, adhesives, welding, etc. or the like type of fasteners and fastening systems may be used in order to achieve the intended functionality of securing or affixing the first rack 102 and first guide rail 108 without relative movement with respect to the work platform 24 and/or the mounting flange 104.

A moving die block 116 may include a second rack 112 and a second guide rail 118 each engaging the moving die block 116. Similarly, it will be understood by one of skill in the art that the expression "engaging" in this particular instance will be read as broadly as possible so as to encompass the second rack 112 and second guide rail 118 connected to the moving die block 116 by any form or manner of connection as commonly known and understood in the art for the applicable structure. For example, threaded fasteners, push-to-lock, over-center, adhesives, welding, etc. or the like type of fasteners and fastening systems may be used in order to achieve the intended functionality of securing or affixing the second rack 112 and second guide rail 118 without relative movement with respect to the moving die block 116.

Preferably, the first and second racks 102, 112 each include a series of rack teeth 120 that are disposed at a spaced offset peak-to-peak or valley-to-valley at a predetermined first pitch P1.

Each of the first and second guide rails 108, 118 includes a pair grooves 114, one formed on the top and one formed on the bottom, that are configured to facilitate precise engagement with the recirculating rolling elements or balls of the respective first and second linear motion bearings 124, 126 so that the first and second linear motion bearings 124, 126 are freely movable along the longitudinal axis of the respective first and second guide rails 108, 118 with very low tolerance of play or slop.

A bearing assembly 122 may include a first linear motion bearing 124 movably coupled to the first guide rail 108 and a second linear motion bearing 126 movably coupled to the second guide rail 118. One of skill in the art will recognize that each of the first and second linear motion bearings 124, 126 may include a single linear motion bearing or a plurality of linear motion bearings, as necessary or desired to provide the intended functionality. In one embodiment, the first linear motion bearing 124 may include a pair of linear motion bearings, both coupled to the first guide rail 108 but disposed in such a configuration so that they are spaced or offset from one another longitudinally along the first guide rail 108, and the second linear motion bearing 126 may include a pair of linear motion bearings, both coupled to the second guide rail 118 but disposed in such a configuration so that they are spaced or offset from one another longitudinally along the second guide rail 118. In one embodiment, balls are re-circulated infinitely by rolling along the groove formed in the first and second guide rails 108, 118 and through the first and second linear motion bearings 124, 126. One of skill in the art will recognize that the balls may be constructed of any suitable material to provide the intended high precision functionality, such as, for example, metal, steel, stainless steel, chrome steel, tool steel, ceramic, silicon nitride ceramic, aluminum oxide ceramic, plastic, and the like, etc.

Since the rolling element linear motion bearings operate at their highest life capability when the rolling or oscillation force is directly in-line with the guide rails. The use of a pair of linear motion bearings 124, 126, in one embodiment, doubles the surface area of the bearing and distributes the off-angle pressure developed from the normal forces created by the pitman arm 12 or flywheel 26 of the thread rolling machine 20 into pure linear motion. All the energy of the rolling operation is transferred through the pitman arm 12 to the moving die block 116. Any off-angle force (or reaction force) is distributed by the bearing assembly 122.

A gear reduction assembly 130 may include a plate 132 connected to each of the first and second linear motion bearings 124, 126 and a pinion gear 134 mounted to a pinion shaft 135. In one embodiment, the pinion gear 134 is centrally disposed along the longitudinal axis of the plate 132 so that the longitudinally spaced first and second linear motion bearing pairs 124, 126 are disposed on both sides. The pinion gear 134 includes a plurality of gear teeth 136 that are disposed at a spaced offset peak-to-peak or valley-to-valley at a predetermined second pitch P2. Preferably, the pinion gear 134 extends from and is rotatably connected to the plate 132 so that the gear teeth 136 are disposed in registered synchronous alignment and meshing engagement with the rack teeth 120 so as to function much like a pinion in a rack and pinion arrangement such that a relative desired gear reduction may be achieved. By adjusting the pitch ratio (i.e., P1/P2) of the gear teeth 136 and the rack teeth 120, a desired gear reduction can be achieved. In one embodiment, a one-half (½) speed reduction is advantageous to overcome the disadvantages of the prior art. Manufacturing speeds for thread rolling equipment require up to 300 strokes per min, but linear bearings cannot operate at this speed. However, a one-half (½) speed gear reduction reduces the operating speed of the first and second linear motion bearings 124, 126 to a linear feet per minute range that is at an acceptable rate for the operating parameters thereof.

FIGS. 5A-7B show the operation of the high precision thread rolling assembly 100 in accordance with one embodiment of this disclosure. An advantage of the high precision thread rolling assembly 100 of the present disclosure is that the centerline of rolling pressure CLRP imparted to the cylindrical blank 200 by the moving die 140 and the stationary die 142 is always supported by the first and second linear motion bearings 124, 126. This is important, advantageous, and a significant development over the prior art because thread rolling produces impact pressure force at the beginning of each stroke as the cylindrical blank engages the dies 140, 142. An additional advantage of one embodiment of this new development as set forth in this disclosure is that the impact pressure force is absorbed and spread throughout two pairs of linear motion bearings 124, 126 (where each bearing can take a shock load much lower than is rated specification limit).

In one embodiment, the centerline of rolling pressure CLRP is aligned in registration with the pinion gear 134 that is centrally disposed and supported between equally spaced pairs of linear motion bearings of the first and second linear motion bearings 124, 126.

In FIGS. 5A and 5B the beginning or start of the stroke is shown where the cylindrical blank 200 is introduced between the moving die 140 and the stationary die 142. The center axis of the pinion gear 134 is generally aligned with a center axis of the cylindrical blank 200 at the start of the roll or stroke when the cylindrical blank 200 engages the leading edges of the moving die 140 and the stationary die 142. FIG. 5B removes the first and second linear motion bearings to provide a clear view of the pinion gear 134 in meshed engagement with the first and second racks 102, 112 and alignment of the center axes of the pinion gear 134 and cylindrical blank 200. In accordance with this disclosure, the flywheel 26 and connected pitman arm 12 actuate the moving die block 116 to traverse in linear motion.

In FIG. 6 the center or middle of the stroke is shown where the center axis of the pinion gear 134 is still generally aligned with a center axis of the cylindrical blank 200 at the center or middle of the roll or stroke when the cylindrical blank 200 engages the central portion of the moving die 140 and the stationary die 142 so that the cylindrical blank 200 is being formed into a threaded fastener.

In FIGS. 7A and 7B the end of the stroke is shown where the cylindrical blank 200 is roughly aligned with the trailing edge of the moving die 140 and the stationary die 142 as the thread rolling process is being completed. The center axis of the pinion gear 134 is still generally aligned with a center axis of the cylindrical blank 200 at the end of the roll or stroke when the cylindrical blank 200 engages the trailing edges of the moving die 140 and the stationary die 142. FIG. 7B removes the first and second linear motion bearings to provide a clear view of the pinion gear 134 in meshed engagement with the first and second racks 102, 112 and alignment of the center axes of the pinion gear 134 and cylindrical blank 200.

The foregoing operation in accordance with this disclosure is important because the centerline of rolling pressure or compression load CLRP on the cylindrical blank 200 is best handled when it is centered on or within the first and second linear motion bearings 124, 126, which also enables long bearing life. The centerline of the bearing assembly 122 (in this embodiment is aligned with the center axis of the pinion gear 134 by design) and cylindrical blank 200 stay in close alignment throughout each stroke of the rolling process which keeps the pressure or load in the middle of the first and second linear motion bearings 124, 126. One of skill in the art will recognize that during one complete stroke as illustrated in FIGS. 5A-7B the moving die 140 traverses a linear distance D1 that is twice as much as the linear distance D2 traversed by the first and second linear motion bearings 124, 126. This is a result of the configuration of the gear reduction assembly 130 wherein the linear speed experienced by the first and second linear motion bearings 124, 126 is one-half of the linear speed of the moving die block 116, second rack 112 and second guide 118.

Consequently, conventional equipment can be retro-fit with or converted to the high precision thread rolling assembly 100 and produce excellent thread rolled products. There are only a few fasteners to remove or uninstall the existing oil film ways, moving carrier die block, pitman arm pin and other related items. Once these fasteners are removed, the whole conventional oil fil way assembly and moving carrier die block can be removed. The assembly of the high precision thread rolling assembly 100 of the present disclosure may be directly installed, as described above, with the same fasteners and reuses the pitman arm and pin. However, some initial set-up is required, namely, final and onetime adjustments are made ensuring the moving die pocket 144 and the stationary die pocket 146 are parallel in two directions (top to bottom) and (front to back) Additionally, the distance between the moving and stationary die pockets 144, 146 are set to a pre-determined standard. This standard distance is fine-tuned by using a calibrated block that is supported between both the stationary and moving die pockets 144,146. Once the calibrated block is installed, the fasteners for securing the stationary die block to the work platform 24 and the high precision thread rolling assembly 100 to the mounting flange 104 and/or work surface 24 are tightened and the position is secured. This position can be checked and reconfirmed on a regular basis, though not necessary, by using an established calibrated block. The high precision thread rolling assembly 100 will not operate at the pre-determined standard distance repeatable over millions of strokes without statistically significant variation.

FIGS. 8-10 illustrate an adjustment assembly 220 for use in connection with the set-up and operation of the high precision thread rolling assembly 100 with a specific thread forming recipe, after the initial set-up and calibration described above. The adjustment assembly 220 may include a pair of stationary button blocks 222 disposed between the stationary die block 106 and the stationary die 142, and a pair of moving button blocks 224 and recipe blocks 226 disposed between the moving die block 116 and the moving die 140. Each of the stationary and moving button blocks 222, 224 may include a pair of apertures configured to receive a die button 228. The die buttons 228 may have any desired thickness that is greater than the thickness of the respective stationary or moving button blocks 222, 224, such as for each one thousandth of an inch greater than the thickness of the stationary or moving button blocks 222, 224. For example, if the stationary and moving button blocks 222, 224 have a thickness of 0.250" them the die buttons may have thicknesses of 0.251", 0.252", 0.253", 0.254", etc. By matching or mixing die button 228 thicknesses. In one embodiment, the die buttons 228 can adjust the top front, bottom front, top back and bottom back of each of the moving and stationary dies 140, 142 independently, which is required to adjust for taper in cylindrical blank 200 and thread type. When manufacturing space threads, the faces of the moving and stationary dies 140,142 should run parallel. However, when manufacturing machine threads, the faces of the moving and stationary dies 140,142 should be tapered. Every screw thread form has its own unique recipe. The adjustment assembly 220 of the present disclosure can accommodate any conceivable recipe and can be changed out without removing the moving or stationary dies 140, 142. In one embodiment, the die buttons 228 are removably fixed to the stationary and moving button blocks 222, 224 on a temporary basis, such as by a magnet or the like, etc. When there are large changes, the recipe block 226 is used to accommodate the screw variation so that the desired combination can be easily repeated and communicated to unskilled labor. Traditionally, all of these adjustments are made with a threaded actuator as the natural variation in oil film ways did not allow the die pocket to be consistent enough to allow for predictive adjustments.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

Any other undisclosed or incidental details of the construction or composition of the various elements of the disclosed embodiment of the present invention are not believed to be critical to the achievement of the advantages of the present invention, so long as the elements possess the attributes needed for them to perform as disclosed. Certainly, one skilled in the mechanical arts would be able to conceive of a wide variety of alternatives, configurations and successful combinations thereof. The selection of these and other details of construction are believed to be well within the ability of one of even rudimental skills in this area, in view of the present disclosure. Illustrative embodiments of the present invention have been described in considerable detail for the purpose of disclosing a practical, operative structure whereby the invention may be practiced advantageously. The designs described herein are intended to be exemplary only. The novel characteristics of the invention may be incorporated in other structural forms without departing from the spirit and scope of the invention. The invention encompasses embodiments both comprising and consisting of the elements described with reference to the illustrative embodiments. Unless otherwise indicated, all ordinary words and terms used herein shall take their customary meaning as defined in The New Shorter Oxford English Dictionary, 1993 edition. All technical terms shall take on their customary meaning as established by the appropriate technical discipline utilized by those normally skilled in that particular art area. All medical terms shall take their meaning as defined by Stedman's Medical Dictionary, 27th edition.

The invention claimed is:

1. A high precision thread rolling assembly comprising a mounting flange secured to a work platform, the assembly further comprising:

a first rack and a first guide rail each fixed to the mounting flange;

a moving die block including a second rack and a second guide rail each connected to the moving die block, wherein the first and second racks each include a series of rack teeth;

a bearing assembly comprising:

a first linear motion bearing movably coupled to the first guide rail; and a second linear motion bearing movably coupled to the second guide rail; and a gear reduction assembly comprising:

a plate connected to each of the first and second linear motion bearings, wherein the plate is located between the first guide rail and the second guide rail; and a pinion gear including a plurality of gear teeth, wherein the pinion gear is rotatably connected to the plate so that the gear teeth are disposed in meshing engagement with the first and second rack teeth.

2. The assembly of claim 1, wherein the rack teeth are formed with a first pitch and the gear teeth are formed with a second pitch such that when the moving die block is moved a first distance along its longitudinal axis the first and second bearings move a portion of the first distance as defined by a ratio of the first pitch to the second pitch.

3. The assembly of claim 1, wherein the moving die block includes a moving die disposed within a moving die pocket and a pair of button blocks disposed between the moving die and the moving die pocket, wherein each of the pair of button blocks has a pair of apertures defined therein and each of the pair of apertures has a die button disposed therein.

4. The assembly of claim 3, wherein each of the pair of apertures of each of the pair of button blocks comprises an upper aperture and a lower aperture, so that cooperatively the moving die is adjustable for taper and tilt.

5. The assembly of claim 3, further comprising a stationary die block that is connected to the work platform spaced from the moving die block, wherein the stationary die block includes a stationary die pocket and a stationary die, wherein a second pair of button blocks are disposed between the stationary die and the stationary die pocket, each of the second pair of button blocks has a pair of apertures defined therein and each of the pair of apertures has a die button disposed therein.

6. The assembly of claim 5, wherein each of the pair of apertures of each of the second pair of button blocks comprises an upper aperture and a lower aperture, so that cooperatively the stationary die is adjustable for taper and tilt.

* * * * *